US008339324B1

(12) United States Patent
Dufilie

(10) Patent No.: US 8,339,324 B1
(45) Date of Patent: Dec. 25, 2012

(54) WIDEBAND BICONICAL ANTENNA WITH HELIX FEED FOR AN ABOVE-MOUNTED ANTENNA

(75) Inventor: Pierre A. Dufilie, Marlborough, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 689 days.

(21) Appl. No.: 12/370,329

(22) Filed: Feb. 12, 2009

(51) Int. Cl.
*H01Q 21/00* (2006.01)
*H01Q 13/00* (2006.01)

(52) U.S. Cl. ..... 343/725; 343/773

(58) Field of Classification Search ..... 343/772, 343/773, 774, 725, 775, 776, 895
See application file for complete search history.

(56) References Cited

U.S. PATENT DOCUMENTS

| | | | | |
|---|---|---|---|---|
| 2,532,551 | A | 12/1950 | Jarvis | |
| 2,533,236 | A | 12/1950 | Felsenheld | |
| 3,795,914 | A | 3/1974 | Pickles | |
| 3,829,863 | A * | 8/1974 | Lipsky | 343/773 |
| 4,477,812 | A | 10/1984 | Frisbee et al. | |
| 5,534,880 | A | 7/1996 | Button et al. | |
| 5,767,814 | A | 6/1998 | Conroy et al. | |
| 6,268,834 | B1 | 7/2001 | Josypenko | |
| 6,593,892 | B2 | 7/2003 | Honda et al. | |
| 7,339,542 | B2 | 3/2008 | Lalezari | |
| 7,408,521 | B2 | 8/2008 | Smith et al. | |
| 7,855,693 | B2 * | 12/2010 | Martek et al. | 343/773 |
| 7,855,696 | B2 * | 12/2010 | Gummalla et al. | 343/876 |

* cited by examiner

*Primary Examiner* — Jacob Y Choi
*Assistant Examiner* — Hasan Islam
(74) *Attorney, Agent, or Firm* — Howard IP Law Group, PC

(57) ABSTRACT

A wideband biconical antenna arrangement is disclosed having a feed arrangement that services a second antenna positioned above the biconical antenna. The feed for the second antenna is configured as a helix that spirals around an outer periphery of the upper and lower cones of the biconical antenna along the biconical antenna's cylindrical radiating aperture. In one embodiment, the feed is a coaxial cable disposed within a hollow metal tube. This helix feed does not substantially degrade the performance of the wideband biconical antenna. The wideband biconical antenna has its feed disposed within a central conduit of the biconical antenna. The biconical antenna has at least one octave of bandwidth, and in one embodiment the second antenna also has at least one octave of bandwidth.

20 Claims, 5 Drawing Sheets

WIDEBAND BICONICAL ANTENNA WITH HELIX FEED FOR AN ABOVE-MOUNTED ANTENNA

FIELD OF THE INVENTION

The invention relates generally to biconical antennas, and more particularly to wideband biconical antennas with an improved feed design for feeding one or more above-mounted antennas.

BACKGROUND OF THE INVENTION

It is known to form an omnidirectional antenna by stacking a plurality of biconical antennas on top of each other. Each biconical antenna is formed by a pair of truncated flared-apart reflecting surfaces. The truncated flared apart surfaces are often conically shaped, with the convex sides of the conical sheets facing one another.

When stacking antennas on top of each other, such as when the antennas are positioned on the mast of a ship or submarine, an antenna feed cable for one biconical antenna must be routed past all antennas located below that antenna. Such cable routings can be critical, because a misplaced cable can alter the radiation pattern of any antenna it passes.

This presents a problem when a wideband biconical antenna design is used beneath an antenna positioned above it within a vertical, cylindrical volume, such as a cylindrical radome, with is the case for submarine communications masts. The challenge is to create a feed that attaches to the upper antenna and that traverses the space occupied by the wideband biconical antenna below. The feed for the antenna positioned above the wideband biconical antenna must not significantly impact the performance of the wideband biconical antenna. In addition, the feeds for each antenna must also be able to reach the hardware that exists at the bottom of the cylindrical volume (in the case of a submarine communications mast).

In some cases, feed cables (e.g., coaxial cables) for the biconical antennas are routed down the center of the stack to avoid complicating the antenna patterns. While providing mechanical stability of the antenna cones (via a central metal tube), such arrangements can limit the antenna's bandwidth. In other arrangements, the feed cables are positioned outside the bicones, for each antenna above another on the vertical stack. This arrangement of the feed cables has the advantage of eliminating the need for routing the cables through the center of the antenna elements in each array. It can, however, induce interference with the outgoing signal, can distort the omnidirectional radiation pattern, and can induce interference with the incoming signal.

Thus, there is a need for an improved feed design for a biconical antenna that enables feed cables to be routed past lower antenna elements to upper antenna elements without affecting the characteristics of the biconical antenna. Specifically, the feed design should not degrade the wideband biconical antenna's input impedance or gain radiation patterns

SUMMARY OF THE INVENTION

The aforementioned problem is solved using a hollow metal tube through which a coaxial cable can be routed to the antenna above the wideband biconical antenna. The metal tube is formed into a helix shape that spirals around the outer edge of the wideband biconical antenna along the cylindrical radiating aperture. A coaxial cable is then fed through the hollow metal tube up to the antenna that exists above the wideband biconical antenna. The hollow metal tube attaches to the upper and lower cones of the wideband biconical antenna. The helix shape of the hollow metal tube is important in that its presence along the radiating aperture of the wideband biconical antenna does not significantly impact the performance of the wideband biconical antenna.

An antenna arrangement is disclosed. The antenna arrangement may comprise a wideband biconical antenna having an outside diameter, and a second antenna mounted above said wideband biconical antenna. The second antenna may have a feed configured in a helical shape with a helix diameter substantially equal to the outer diameter of said wideband biconical antenna such that the second antenna feed does not substantially degrade the performance of the wideband biconical antenna.

A multi-antenna arrangement is also disclosed. The multi-antenna arrangement may comprise a wideband biconical antenna and a second antenna mounted above said wideband biconical antenna. The second antenna may have a feed mounted within a tube formed into a helix shape such that it spirals around an outer edge of the wideband biconical antenna along the wideband biconical antenna's cylindrical radiating aperture. The second antenna feed may not substantially degrade the performance of the wideband biconical antenna.

A vertically mounted antenna arrangement is further disclosed, comprising a wideband biconical antenna having upper and lower cones. The wideband biconical antenna may have a feed disposed within a central conduit of the antenna. The arrangement may further comprise a second antenna mounted above the upper cone. The second antenna may have a coaxial feed disposed within a tube. The tube may be formed in a helix shape that spirals around an outer periphery of the upper and lower cones along the wideband biconical antenna's cylindrical radiating aperture. The second antenna feed does not substantially degrade the performance of the wideband biconical antenna.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION

Figure 1:
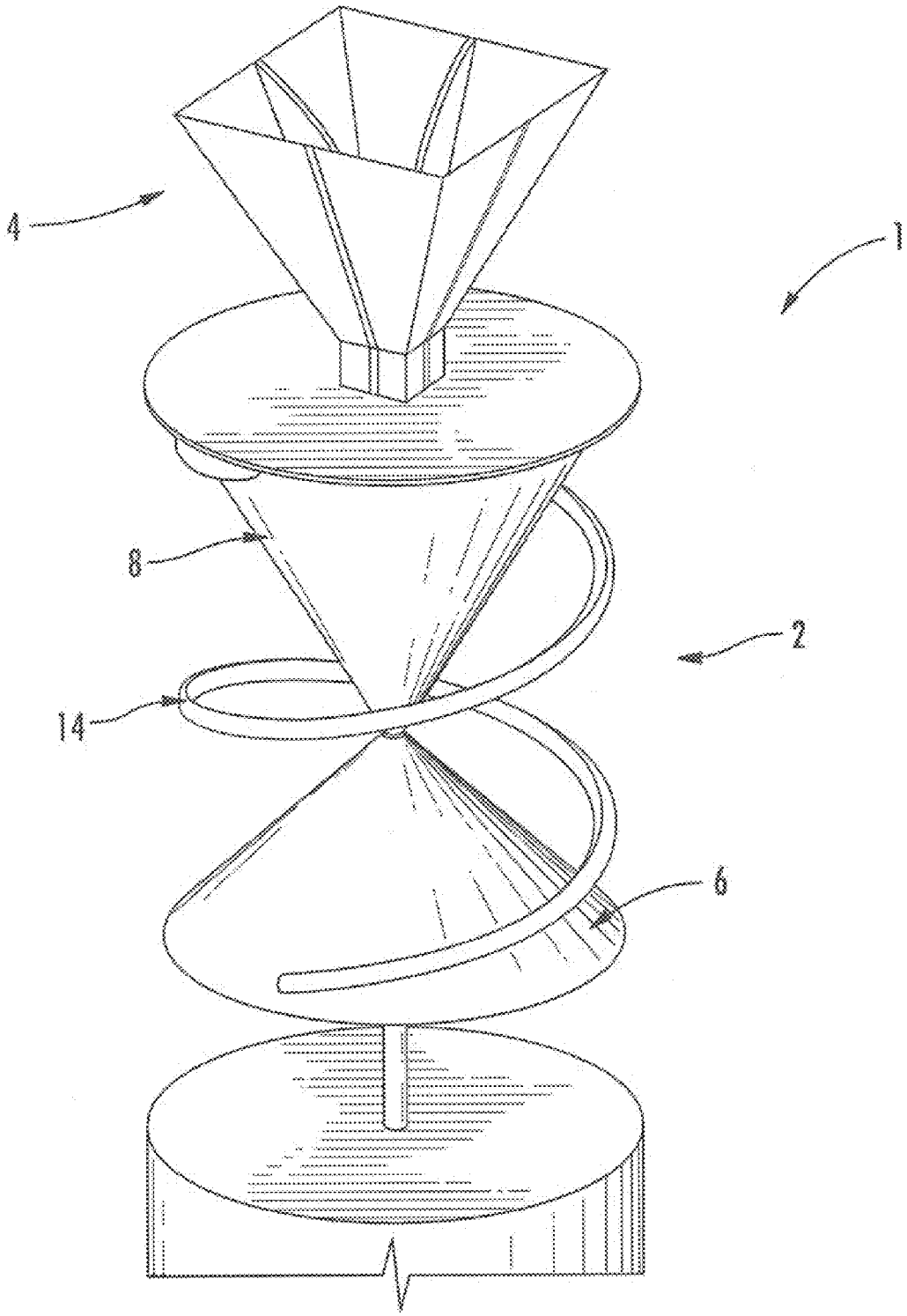
FIG. 1 is a perspective view of the novel wideband biconical antenna with helical feed for servicing an above-mounted antenna.

This description of the disclosed embodiments is intended to be read in connection with the accompanying drawings, which are to be considered part of the entire written description of this disclosure. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Referring now to FIG. 1, a stacked antenna arrangement 1 is disclosed, comprising a wideband biconical antenna 2 and at least a second antenna 4 mounted above the biconical antenna 2. The biconical antenna 2 may comprise first and second cones 6, 8 that are fed via a feed line 10 disposed within a central conduit 12 of the biconical antenna.

The second antenna 4 may have a feed 14 that wraps around the perimeter of the biconical antenna 2 along the biconical antenna's cylindrical radiating aperture. Specifically, the feed 14 may be configured in a helical shape with a helix diameter "HD" substantially equal to the outer diameter "BD" of the biconical antenna 2 (see FIG. 2). In one embodiment, illustrated in FIG. 3, the helical feed 14 comprises a hollow tube 16 that contains a coaxial feed line 18 for the second antenna 4. The hollow tube 16 may be formed from a metal, such as aluminum, copper, brass or it can be formed from any of a variety of suitable non-metallic materials, such as hard plastic. In addition, the helical feed 14 need not contain only a coaxial feed line 18, but could also contain a power feed, such as a DC feed line, that could power an amplifier for the second antenna.

In one exemplary embodiment, both the biconical antenna 2 and the second antenna 4 have at least one octave of bandwidth. In addition, the second antenna 4 may have a frequency band, a radiation pattern and/or a broadband characteristic that is different from that of the biconical antenna.

The second antenna 4 is illustrated as being an ultra-wideband quad-ridge horn antenna. A quad-ridge horn antenna is directional (in terms of its radiation pattern), unlike the biconical antenna 2, and it can exhibit ultra-wide bandwidth (upwards of 10:1 bandwidth). The helical feed 14 around the biconical antenna 2 allows the quad-ridge horn antenna 4 to maintain this wideband feed performance. Also, it is anticipated that the quad-ridge horn antenna 4 may operate over a different frequency band than the biconical antenna. It will be appreciated that a quad-ridge horn antenna is but one possible option for use as the second antenna 4, and other antenna designs can also be used. A non-limiting listing of such antenna designs includes directional antennas such as microstrip patch antennas, slot antennas, spiral antennas, conical log spiral antennas, conical and rectangular horn antennas, and printed antenna arrays. A non-limiting listing of omnidirectional antennas that can be used as the second antenna include broadband dipole antennas, and helix antennas (e.g., bifilar, quadrifilar).

Figure 2:
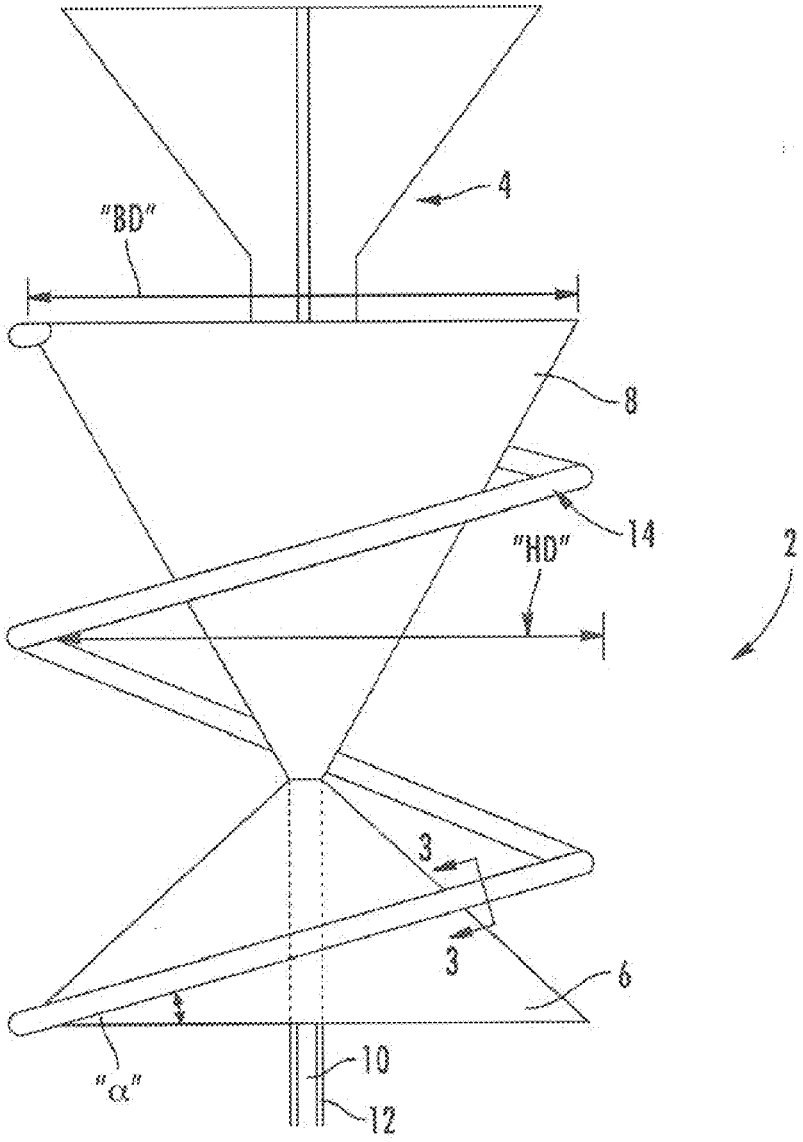
FIG. 2 is a side view of the novel wideband biconical antenna with helical feed of FIG. 1.
Figure 3:
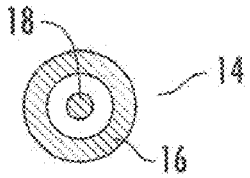
FIG. 3 is a cross-section view of the helical feed of FIGS. 1 and 2, taken along line 3-3 of FIG. 2.

FIG. 2 shows a side view of the helical feed 14 of FIG. 1. As previously noted, the helical feed 14 has a diameter "HD" that enables the feed to fit closely about the outside diameter "BD" of the first and second cones 6, 8 of the biconical antenna 2. In one exemplary embodiment, the helical feed 14 may have a pitch angle "α" of about 5 degrees to about 35 degrees, and in one embodiment the pitch angle "α" of about 12.6 degrees.

A benefit of the disclosed arrangement of the helical feed 14 is that it does not substantially degrade the biconical antenna's 2 performance. Specifically, the helical feed 14 does not alter the biconical antenna's input impedance by more than +/−5% within the operational bandwidth. The helical feed 14 also does not alter the antenna's gain radiation patterns by more than +/−0.5 dB (decibels) within the 3 dB beamwidth region. In addition, the helical feed 14 arrangement does not substantially degrade gain variation of the second antenna 4 by more than plus or minus 0.5 dB within the 3 dB beamwidth region.

Figure 4:
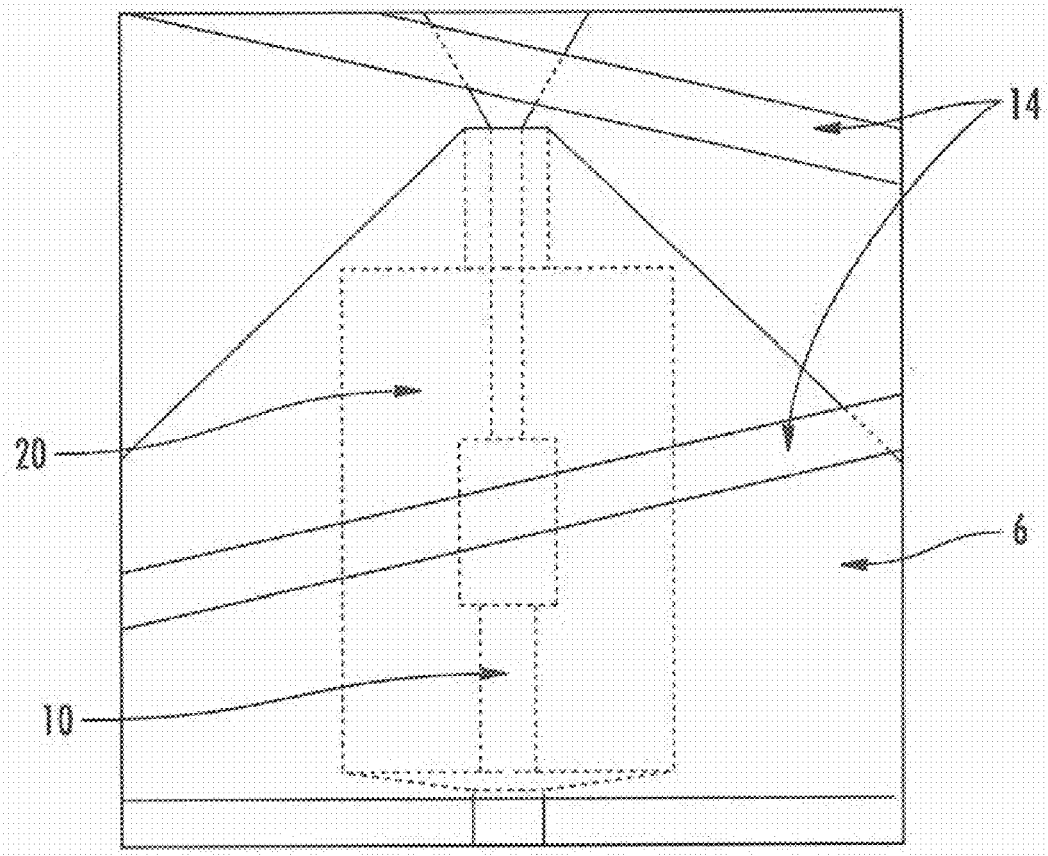
FIG. 4 is a perspective view of a portion of the antenna of FIG. 1 including a coaxial matching network.

FIG. 4 shows an exemplary coaxial matching network 20 disposed beneath/within the first cone 6. This coaxial matching network 20 may be employed to match the biconical antenna 2 to the coaxial feed line 10. In the illustrated embodiment, the coaxial matching network utilizes a stepped impedance transformer design that provides an impedance match from the coaxial feed line to the biconical antenna 2. Other matching networks may be used, as appropriate, such as a stripline, microstrip, or lumped elements on a circuit board, and the like.

Notably, the novel helical arrangement for the feed 14 has minimal impact to the biconical antenna's input impedance, and has a small impact to its gain patterns. Although the helical feed 14 acts as a polarizer, the slanting of the resulting radiated electric field is minimal. An antenna that does not exhibit physical rotational symmetry will typically exhibit asymmetrical radiation patterns. Although the helical feed 14 is asymmetrical in azimuth, the impact to the gain variation is minimal at most frequencies.

Figure 5:
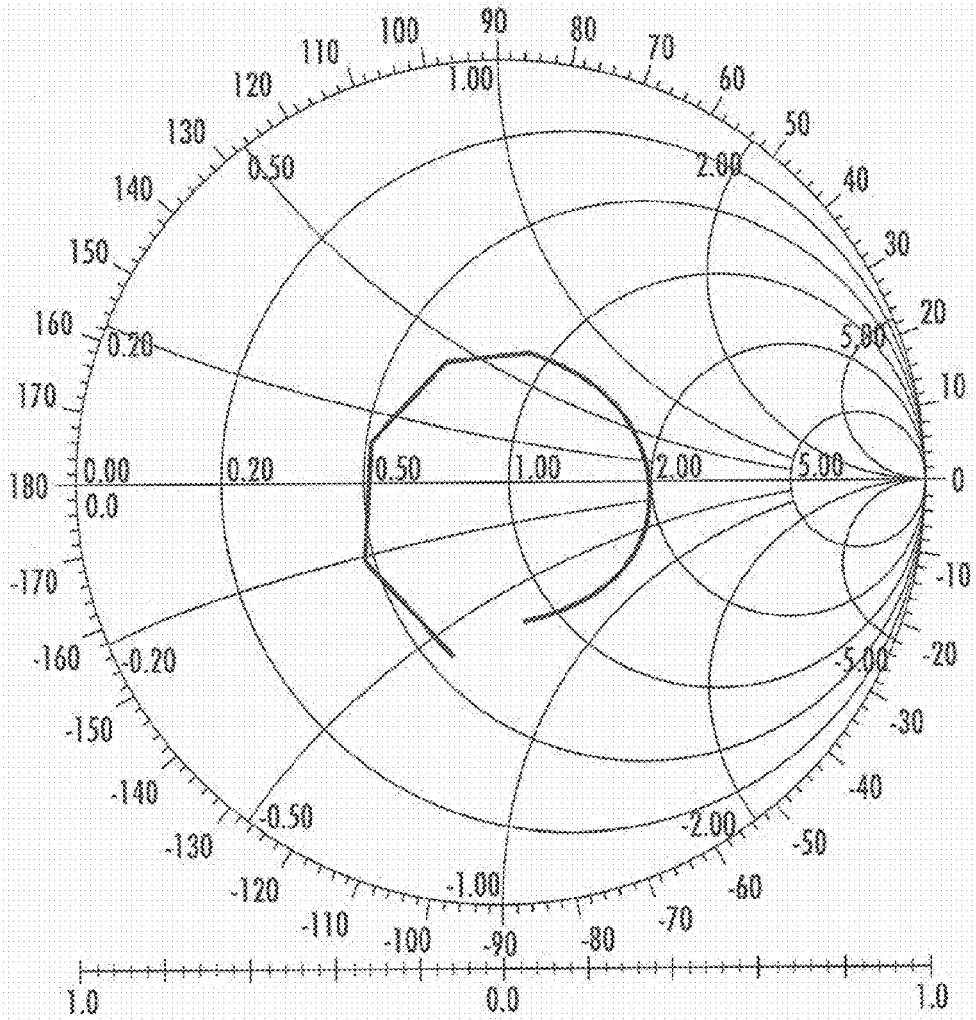
FIG. 5 is a graphical representation of the performance of the antenna of FIG. 1.

As can be seen in FIG. 5, a voltage standing wave ratio (VSWR) of 2:1 can be achieved with the disclosed design. That is, the disclosed biconical antenna 2 demonstrates a 2:1 frequency bandwidth (one octave) or 67%, from about 1.0 GHz to about 2.0 GHz. This demonstrates that the disclosed helical feed design for the second antenna 4 enables the combined assembly of a broadband omnidirectional antenna (biconical antenna 2) having at least one octave of bandwidth, with a separate above-mounted antenna (second antenna 4) having different operating characteristics (e.g., frequency band, a radiation pattern and/or a broadband characteristic) than the omnidirectional antenna.

Figure 6:
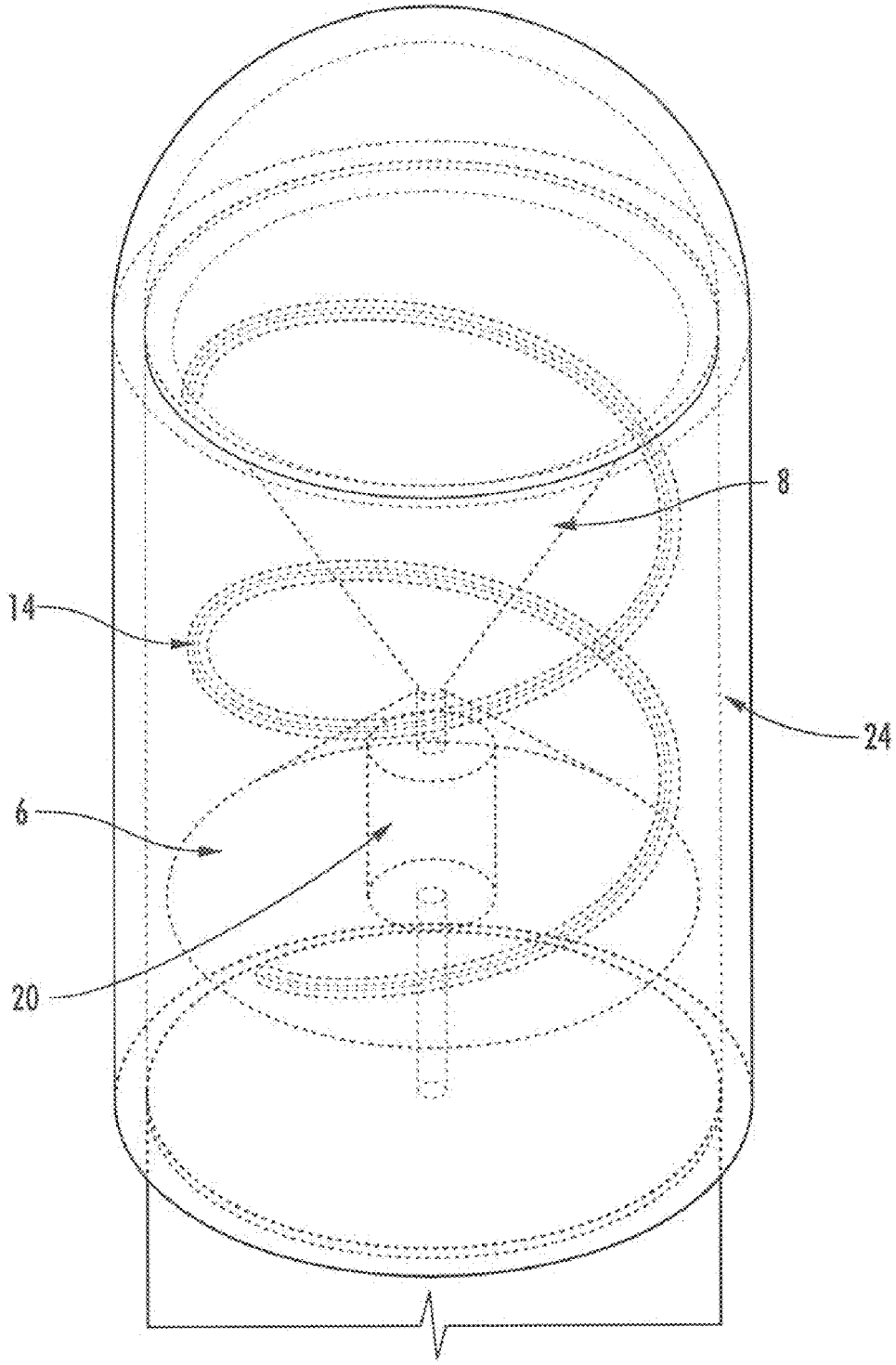
FIG. 6 is a perspective view of the antenna of FIG. 1 positioned within an exemplary radome.

FIG. 6 shows an exemplary implementation of the disclosed biconical antenna 2 with helical feed 14, namely, disposed within a radome 24 of a submarine. This example shows the advantage of the helical feed design for an application in which the majority of the cylindrical enclosure volume of the radome is occupied by the biconical antenna 2. The disclosed feed design is advantageous for such applications because it occupies no additional space outside the volume of the biconical antenna 2.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. An antenna arrangement, comprising:

a wideband biconical antenna including first and second three-dimensional cones;

a second antenna mounted above said wideband biconical antenna;

wherein the second antenna has a feed configured in a helical shape such that the second antenna feed is substantially within a generally cylindrical volume defined by the outer diameters of a base of each of the first and second three-dimensional cones of said wideband biconical antenna and such that the second antenna feed does not substantially degrade the performance of the wideband biconical antenna.

2. The antenna arrangement of claim 1, wherein the second antenna feed does not substantially degrade the biconical antenna's input impedance or gain radiation patterns.

3. The antenna arrangement of claim 1, wherein the second antenna feed is asymmetrical in azimuth and does not substantially degrade gain variation of the second antenna.

4. The antenna arrangement of claim 1, wherein a feed for the wideband biconical antenna is disposed within a central shaft of the wideband biconical antenna.

5. The antenna arrangement of claim 1, wherein the second antenna feed comprises a coaxial cable disposed within a hollow tube.

6. The antenna arrangement of claim 1, wherein the biconical antenna has at least one octave of bandwidth.

7. The antenna arrangement of claim 1, wherein the second antenna has at least one of a frequency band, a radiation pattern, and a broadband characteristic that is different from that of the biconical antenna.

8. The antenna arrangement of claim 7, wherein the second antenna has at least one octave of bandwidth.

9. A multi-antenna arrangement, comprising:

a wideband biconical antenna including first and second three-dimensional cones;

a second antenna mounted above said wideband biconical antenna, the second antenna having a feed mounted within a tube formed into a helix shape such that it spirals substantially within a generally cylindrical volume defined by an outer edge of a base of each of the first and second three-dimensional cones of the wideband biconical antenna along the wideband biconical antenna's cylindrical radiating aperture;

wherein the second antenna feed does not substantially degrade the performance of the wideband biconical antenna.

10. The antenna arrangement of claim 9, wherein the second antenna feed does not substantially degrade the biconical antenna's input impedance or gain radiation patterns.

11. The antenna arrangement of claim 9, wherein the second antenna feed is asymmetrical in azimuth and does not substantially degrade gain variation of the second antenna.

12. The antenna arrangement of claim 9, wherein a feed for the wideband biconical antenna is disposed within a central shaft of the wideband biconical antenna.

13. The antenna arrangement of claim 9, wherein the second antenna feed comprises a coaxial cable disposed within a hollow tube.

14. The antenna arrangement of claim 9, wherein the biconical antenna has at least one octave of bandwidth.

15. The antenna arrangement of claim 9, wherein the second antenna has at least one of a frequency band, a radiation pattern, and a broadband characteristic that is different from that of the biconical antenna.

16. The antenna arrangement of claim 15, wherein the second antenna has at least one octave of bandwidth.

17. A vertically mounted antenna arrangement, comprising:

a wideband biconical antenna including upper and lower three dimensional cones, said wideband biconical antenna having a feed disposed within a central conduit of the antenna; and a second antenna mounted above said upper cone, the second antenna having a coaxial feed disposed within a tube;

wherein the tube is formed in a helix shape that spirals substantially within a generally cylindrical volume defined by an outer periphery of the upper and lower cones along the wideband biconical antenna's cylindrical radiating aperture; and wherein the second antenna feed does not substantially degrade the performance of the wideband biconical antenna.

18. The antenna arrangement of claim 17, wherein the second antenna feed tube helix is asymmetrical in azimuth and does not substantially degrade the wideband biconical antenna's input impedance or gain radiation patterns.

19. The antenna arrangement of claim 18, wherein the wideband biconical antenna has at least one octave of bandwidth.

20. The antenna arrangement of claim 19, wherein the second antenna has at least one octave of bandwidth.

* * * * *